US008508466B2

(12) United States Patent
Kim et al.

(10) Patent No.: US 8,508,466 B2
(45) Date of Patent: Aug. 13, 2013

(54) DRIVING METHOD FOR ELECTROPHORETIC DISPLAY

(75) Inventors: Joo-Young Kim, Suwon-si (KR); Cheol-Woo Park, Suwon-si (KR)

(73) Assignee: Samsung Display Co., Ltd. (KR)

( * ) Notice: Subject to any disclaimer, the term of this patent is extended or adjusted under 35 U.S.C. 154(b) by 1687 days.

(21) Appl. No.: 11/928,178

(22) Filed: Oct. 30, 2007

(65) Prior Publication Data

US 2008/0136773 A1 Jun. 12, 2008

(30) Foreign Application Priority Data

Dec. 12, 2006 (KR) ..... 10-2006-0126160

(51) Int. Cl.
*G09G 3/34* (2006.01)

(52) U.S. Cl.
USPC ..... 345/107; 345/55; 345/82; 359/296

(58) Field of Classification Search
None
See application file for complete search history.

(56) References Cited

U.S. PATENT DOCUMENTS

| | | | | |
|---|---|---|---|---|
| 2004/0227720 | A1 | 11/2004 | Shikina et al. | |
| 2005/0024353 | A1 * | 2/2005 | Amundson et al. | 345/204 |
| 2005/0062714 | A1 | 3/2005 | Zehner et al. | |
| 2006/0050361 | A1 | 3/2006 | Johnson | |
| 2006/0152475 | A1 | 7/2006 | Zhou et al. | |
| 2006/0170647 | A1 * | 8/2006 | Zhou et al. | 345/107 |
| 2006/0170667 | A1 | 8/2006 | Zhou et al. | |
| 2007/0075963 | A1 * | 4/2007 | Zhou et al. | 345/107 |
| 2007/0164982 | A1 * | 7/2007 | Zhou | 345/107 |
| 2007/0296690 | A1 * | 12/2007 | Nagasaki | 345/107 |

FOREIGN PATENT DOCUMENTS

| | | |
|---|---|---|
| JP | 2004-094168 | 3/2004 |
| JP | 2004-271609 | 9/2004 |
| JP | 2005-346009 | 12/2005 |
| JP | 2006-023757 | 1/2006 |
| JP | 2006-258995 | 9/2006 |
| JP | 2006-259532 | 9/2006 |
| JP | 2006-522372 | 9/2006 |

(Continued)

OTHER PUBLICATIONS

English Language Abstract, WO 2005004099, Jan. 13, 2005, corresponding to KR 1020060025585.
English Language Abstract, WO 2004036537, Apr. 29, 2004, corresponding to KR 1020050061532.
English Language Abstract, WO 2005050611, Jun. 2, 2005, corresponding to KR 1020060097128.
English Language Abstract, WO 2004066257, Aug. 5, 2004, corresponding to KR 1020050092782.
English Language Abstract, WO 2004066255, Aug. 5, 2004, corresponding to KR 1020050092774.
European Search Report for European Patent Application No. 07023216.0, May 4, 2011, 8 pages.

*Primary Examiner* — Sumati Lefkowitz
*Assistant Examiner* — Jesus Hernandez
(74) *Attorney, Agent, or Firm* — Innovation Counsel LLP

(57) ABSTRACT

A driving method for an electrophoretic display having a plurality of first electrodes, a second electrode, and electrophoretic particles positioned in a plurality of pixel areas between the first electrodes and the second electrode, comprises applying an initial driving voltage to the electrophoretic particles in the pixel areas for a predetermined time, applying a first image-displaying voltage having a opposite polarity to that of the initial driving voltage to the electrophoretic particles in a portion of the pixel areas for a predetermined time after applying the initial driving voltage, and applying a first constant gray-displaying voltage having the opposite polarity to that of the initial driving voltage to the electrophoretic particles positioned in a portion of the pixel areas for a predetermined time after applying the first image-displaying voltage.

According to the driving method for the electrophoretic display according to an embodiment of the present invention, the images displayed in pixel areas are gradually changed to display smoothly such that display performance of the electrophoretic display may be improved and an incidental image may be prevented.

16 Claims, 24 Drawing Sheets

(56) References Cited

FOREIGN PATENT DOCUMENTS

| | | | |
|---|---|---|---|
| KR | 1020050061532 | | 6/2005 |
| KR | 1020050092774 | | 9/2005 |
| KR | 1020050092782 | | 9/2005 |
| KR | 1020060025585 | | 3/2006 |
| KR | 1020060097128 | | 9/2006 |
| WO | 2004-090857 | | 10/2004 |
| WO | 2004090857 | | 10/2004 |
| WO | 2005-004101 | A1 | 1/2005 |
| WO | 2005052904 | | 6/2005 |

* cited by examiner

DRIVING METHOD FOR ELECTROPHORETIC DISPLAY

CROSS-REFERENCE TO RELATED APPLICATION

This application claims priority to and the benefit of Korean Patent Application No. 10-2006-0126160 filed in the Korean Intellectual Property Office on Dec. 12, 2006, the entire contents of which are incorporated herein by reference.

BACKGROUND OF THE INVENTION

1. Field of the Invention

The present invention relates to a driving method for an electrophoretic display.

2. Description of the Related Art

Among flat panel displays, the electrophoretic display includes a thin film transistor array panel including pixel electrodes connected to thin film transistors, a common electrode panel including a common electrode, and electrophoretic particles interposed between the two panels, having positive or negative charges, and moving between the pixel electrode and the common electrode.

An electrophoretic display includes, a driving unit that supplies a common voltage to the common electrode and data voltages that are higher or lower than the common voltage to each pixel electrode. The difference between the common voltage and the data voltage forms a positive or negative driving voltage to electrophoretic particles located in each pixel area. The electrophoretic particles having positive or negative charges are moved to the pixel electrode or the common electrode depending on the driving voltage. The movement of the electrophoretic particles is controlled by the duration of the driving voltages.

Driving voltages having different durations are supplied to each pixel area, and the electrophoretic particles in each pixel area are moved and arranged in a different manner. External light incident on the electrophoretic display is absorbed or reflected by the electrophoretic particles that are moved and arranged in a different manner at each pixel area to display black, white, or various colors.

The driving voltages are supplied to the electrophoretic particles repeatedly such that electrical charges may be accumulated at each pixel electrode and cause a spurious image to be displayed. To prevent the spurious image, the accumulated electric charges must be removed at regular intervals to refresh the pixel electrode. The polarity of the driving voltages supplied with the electrophoretic particles for each pixel area is periodically reversed per frame to refresh the pixel electrode. The inversion of the driving voltages causes the electrophoretic display to display a real image and an inverse image.

However, the inverse image displayed between the real images may adversely affect display performance.

SUMMARY OF THE INVENTION

The present invention provides a driving method for an electrophoretic display that prevents spurious images by refreshing the pixel electrode. The electrophoretic display which includes a plurality of first electrodes, a second electrode, and electrophoretic particles positioned in a plurality of pixel areas between the first electrodes and the second electrode is driven by applying an initial driving voltage to the electrophoretic particles for a predetermined time, applying a first image-displaying voltage having the opposite polarity to that of the initial driving voltage to the electrophoretic particles for a predetermined time after applying the initial driving voltage, and applying a first constant gray-displaying voltage having the opposite polarity to that of the initial driving voltage to the electrophoretic particles in a portion of the pixel areas for a predetermined time after applying the first image-displaying voltage.

The value of integrating the initial driving voltage over time it is applied may be substantially the same as that of integrating the first image-displaying voltage and the first constant gray-displaying voltage over the time they are applied.

The initial driving voltage, the first image-displaying voltage, and the first constant gray-displaying voltage may have substantially the same magnitude.

The respective pixel areas may display a first color image by applying the initial driving voltage, the plurality of pixel areas may display any one color image of the first color image, a second color image, a third color image, and a fourth color image by applying the first image-displaying voltage, respectively, and the respective pixel areas may display the fourth color image by applying the first constant gray-displaying voltage.

The first color image may be the brightest white and the fourth color image may be the darkest black, the second color image may be darker than the first color image, and the third color image may be darker than the second color image.

The initial driving voltage may be applied for a first time, the first image-displaying voltage may be applied for one of a second time, a third time, and a fourth time, and the first constant gray-displaying voltage may be applied for one of a fifth time, a sixth time, and a seventh time.

The fourth time may be substantially the same as the first time.

The length of the second time may be about one third of that of the fourth time, and the length of the third time may be about two thirds of that of the fourth time.

The fifth time may be substantially the same as the first time.

The length of the sixth time may be about two thirds of that of the fifth time, and the length of the seventh time may be about one third of that of the fifth time.

When the applying time of the first constant gray-displaying voltage for displaying the fourth color image is the sixth time, the first constant gray-displaying voltage may be applied after the eighth time is passed, and when the applying time of the first constant gray-displaying voltage for displaying the fourth color image is the seventh time, the first constant gray-displaying voltage may be applied after the ninth time has passed.

The length of the eighth time may be about one third of that of the fifth time, and the length of the ninth time may be about two thirds of that of the fifth time.

The pixel area displaying the first color image of the plurality of the pixel areas may display the second color image after the eighth time has passed.

The pixel area displaying the second color image of the plurality of the pixel areas may display the third color image after the ninth time has passed.

The driving method may further include applying a second image-displaying voltage having the same polarity as the initial driving voltage to the electrophoretic particles positioned in a portion of the plurality of pixel areas for a predetermined time after applying the first constant gray-displaying voltage, applying a second constant gray-displaying voltage having the same polarity as the initial driving voltage to the electrophoretic particles positioned in a portion of the plurality of pixel areas for a predetermined time after applying the second image-displaying voltage, and applying a compensation voltage having an opposite polarity to that of the initial driving voltage to the electrophoretic particles positioned in the plurality of pixel areas for a predetermined time after applying the second constant gray-displaying voltage.

The value of integrating the second image-displaying voltage and the second constant gray-displaying voltage with applying time thereof may be substantially the same as that of integrating the compensation voltage with applying time thereof.

The second image-displaying voltage, the second constant gray-displaying voltage, and the compensation voltage may have substantially the same magnitude as the initial driving voltage.

The plurality of pixel areas may display any one color image of the first color image, a second color image, a third color image, and a fourth color image by applying the second image-displaying voltage, the respective pixel areas may display the first color image by applying the second constant gray-displaying voltage, and the respective pixel areas may display the fourth color image by applying the compensation voltage.

The second image-displaying voltage may be applied for one of a tenth time, an eleventh time, and a twelfth time, the second constant gray-displaying voltage may be applied for one of a thirteenth time, a fourteenth time, and a fifteenth time, and the compensation voltage is applied for an eighteenth time.

The tenth time may be substantially the same as the first time.

The length of the eleventh time is about two thirds of that of the tenth time, and the length of the twelfth time is about one third of that of the tenth time.

The fifteenth time and the eighteenth time may be substantially the same as the tenth time.

The length of the thirteenth time may be about one third of that of the fifteenth time, and the length of the fourteenth time may be about two thirds of that of the fifteenth time.

When the applying time of the second constant gray-displaying voltage for displaying the first color image is the thirteenth time, the second constant gray-displaying voltage may be applied after the seventeenth time is passed, and when the applying time of the second constant gray-displaying voltage for displaying the first color image is the fourteenth time, the second constant gray-displaying voltage may be applied after the sixteenth time has passed.

The length of the sixteenth time may be about one third of that of the fifteenth time, and the length of the seventeenth time may be about two thirds of that of the fifteenth time.

The pixel area displaying the fourth color image of the plurality of the pixel areas may display the third color image after the sixteenth time has passed.

The pixel area displaying the third color image of the plurality of the pixel areas may display the second color image after the seventeenth time has passed.

A driving method for an electrophoretic display according to an embodiment of the present invention, wherein the electrophoretic display includes a plurality of first electrodes, a second electrode, and electrophoretic particles positioned in a plurality of pixel areas between the first electrodes and the second electrode, includes applying a first image-displaying voltage to the electrophoretic particles positioned in a portion of the plurality of the pixel areas for a predetermined time, applying a first constant gray-displaying voltage having the same polarity as that of the first image-displaying voltage to the electrophoretic particles positioned in a portion of the pixel areas for a predetermined time after applying the first image-displaying voltage, applying a second image-displaying voltage having the opposite polarity to that of the first image-displaying voltage to the electrophoretic particles positioned in a portion of the plurality of pixel areas for a predetermined time after applying the first constant gray-displaying voltage, and applying a second constant gray-displaying voltage having the opposite polarity to that of the first image-displaying voltage to the electrophoretic particles positioned in a portion of the plurality of pixel areas for a predetermined time after applying the second image-displaying voltage.

The value of integrating the first image-displaying voltage and the first constant gray-displaying voltage with applying time thereof may be substantially the same as that of integrating the second image-displaying voltage and the second constant gray-displaying voltage with applying time thereof.

The first image-displaying voltage, the first constant gray-displaying voltage, the second image-displaying voltage, and the second constant gray-displaying voltage may have substantially the same magnitude.

DETAILED DESCRIPTION OF THE EMBODIMENTS

Figure 1:
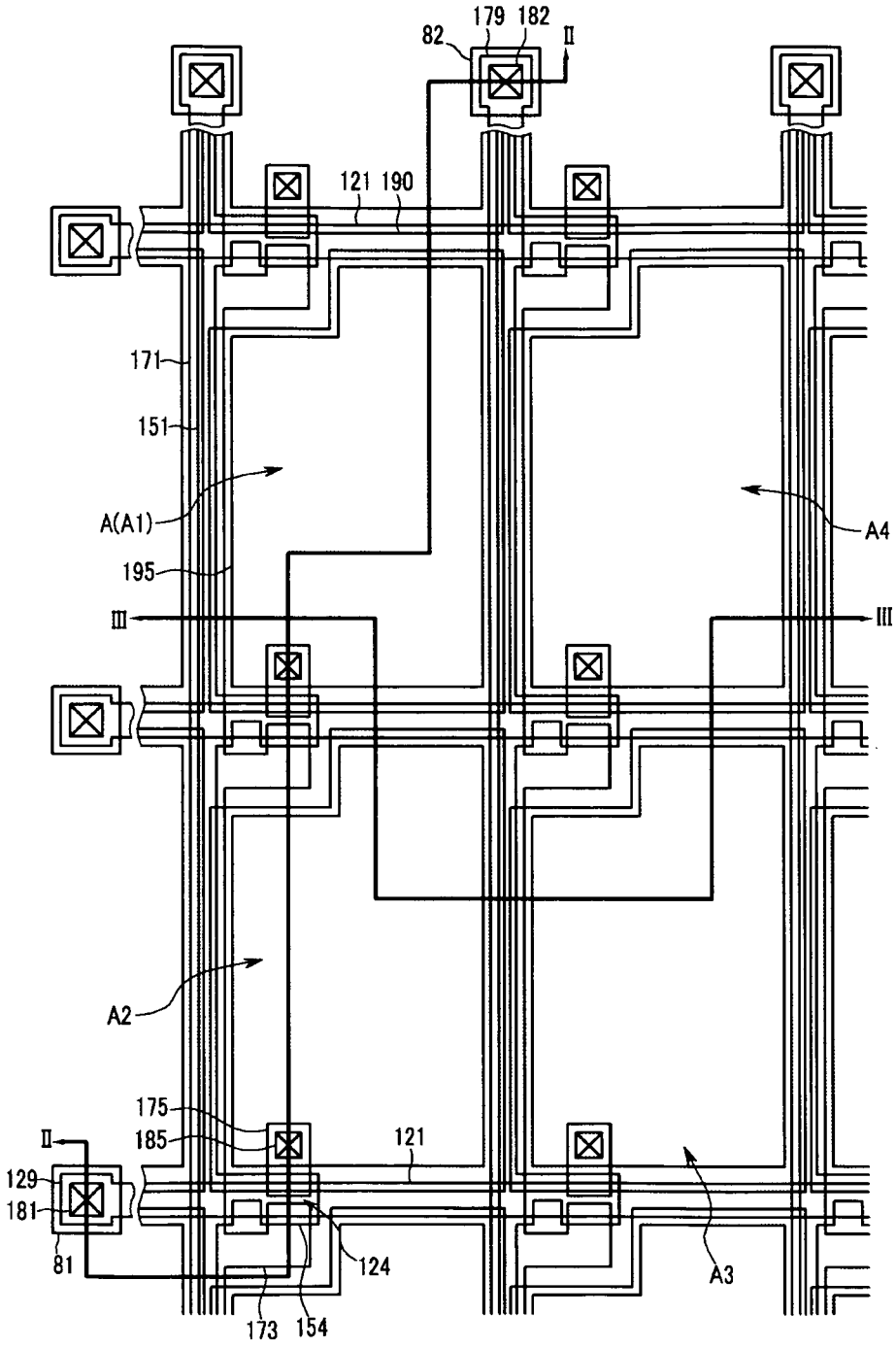
FIG. 1 is a layout view of an electrophoretic display controlled by a driving method according to an embodiment of the present invention.

The present invention will be described more fully hereinafter with reference to the accompanying drawings, in which exemplary embodiments of the invention are shown.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Figure 2:
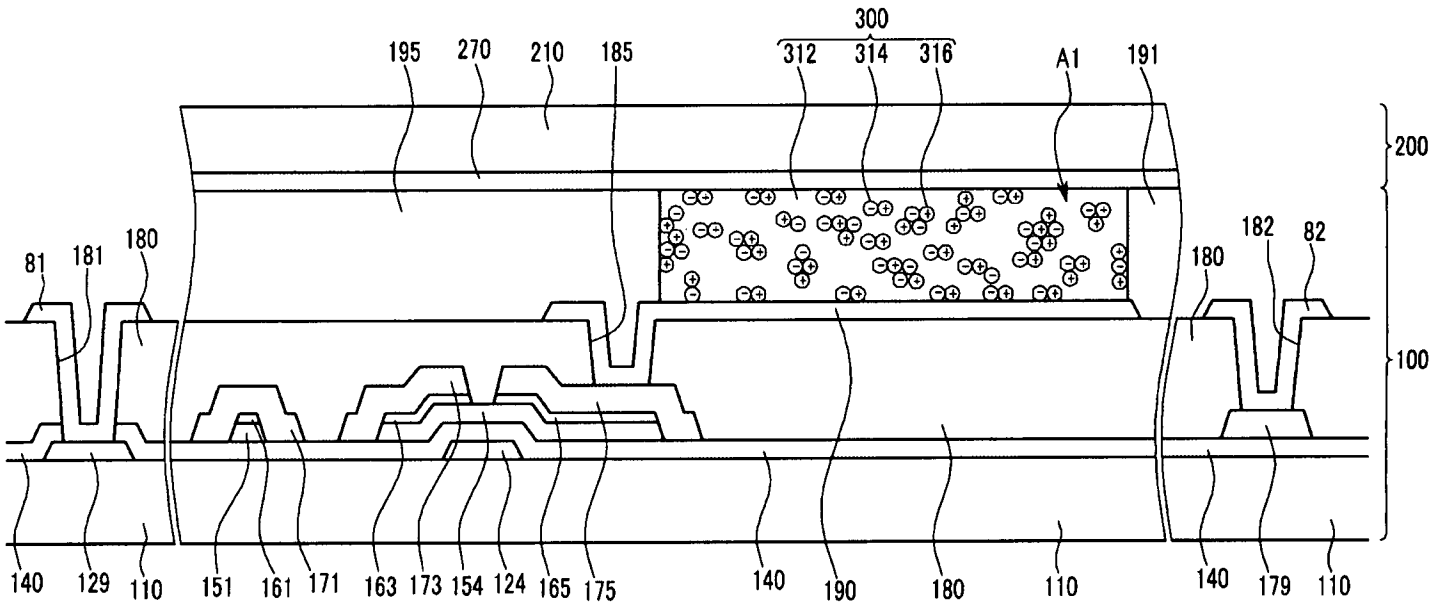
FIG. 2 is a sectional view of the electrophoretic display shown in FIG. 1 taken along the line II-II.

FIG. 1 is a layout view of an electrophoretic display controlled by a driving method according to an embodiment of the present invention, and FIG. 2 is a sectional view of the electrophoretic display shown in FIG. 1 taken along the line II-II.

Figure 3:
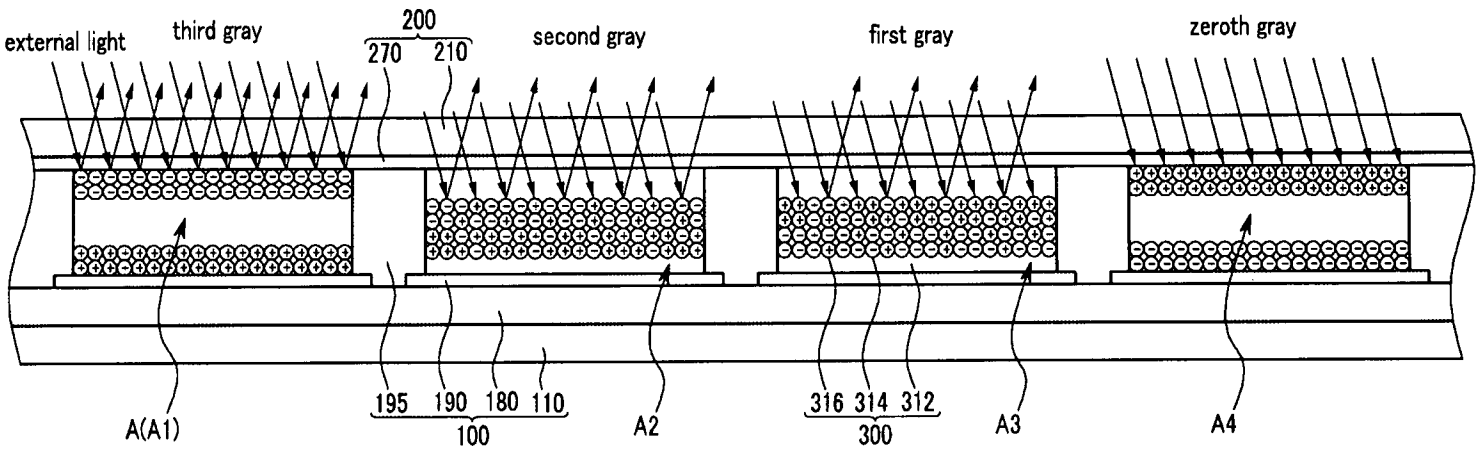
FIG. 3 is a sectional view of the electrophoretic display shown in FIG. 1 taken along the line III-III.

Referring to FIG. 1 and FIG. 3, an electrophoretic display according to one embodiment of the present invention includes a thin film transistor array panel 100, a common electrode panel 200, and an electrophoretic member 300 disposed between the panels 100 and 200.

First, the thin film transistor array panel 100 will be described.

As shown in FIG. 1 and FIG. 2, a plurality of gate lines 121 are formed on an insulation substrate 110 made of a material such as transparent glass or plastic. The gate lines 121 transmit gate signals and extend substantially in a transverse direction. Each of the gate lines 121 includes a plurality of gate electrodes 124 and an end portion 129 having a large area for contact with another layer or an external driving circuit.

The gate lines 121 are preferably made of an Al-containing metal such as Al and an Al alloy, a Ag-containing metal such as Ag and a Ag alloy, a Cu containing metal such as Cu and a Cu alloy, a Mo-containing metal such as Mo and a Mo alloy, Cr, Ta, Ti, etc. The gate lines 121 may include two conductive films, a lower film and an upper film disposed thereon, which have different physical characteristics. The upper film may be made of low resistivity metal including an Al-containing metal such as Al and an Al alloy for reducing signal delay or voltage drop of the gate lines 121. However, the lower film may be made of material such as a Mo-containing metal such as Mo and a Mo alloy, or Cr, which have good physical, chemical, and electrical contact characteristics with other materials such as indium tin oxide (ITO) and indium zinc oxide (IZO). Good examples of the combination of the two films are a lower Cr film and an upper Al—Nd (alloy) film.

In addition, the gate lines 121 may include a single layer preferably made of the above-described materials, and may have a triple-layered structure including the above-described materials. Otherwise, the gate lines 121 may be made of various metals or conductors.

A gate insulating layer 140 preferably made of silicon nitride (SiNx) or silicon oxide (SiOx) is formed on the gate lines 121.

A plurality of semiconductor stripes 151 preferably made of hydrogenated amorphous silicon (abbreviated to "a-Si") or polysilicon are formed on the gate insulating layer 140. Each of the semiconductor stripes 151 extends substantially in the longitudinal direction, and includes a plurality of projections 154 branched out toward the gate electrodes 124. The semiconductor stripes 151 become wide near the gate lines 121 such that the semiconductor stripes 151 cover large areas of the gate lines 121.

A plurality of ohmic contact stripes and islands 161 and 165 are formed on the semiconductor stripes 151. The ohmic contacts 163 and 165 are preferably made of n+ hydrogenated a-Si heavily doped with an n-type impurity such as phosphorous, or they may be made of silicide. Each of the ohmic contact stripes 161 includes a plurality of projections 163, and the projections 163 and the ohmic contact islands 165 are located in pairs on the projections 154 of the semiconductor stripes 151.

A plurality of data lines 171 and a plurality of drain electrodes 175 are formed on the ohmic contacts 161 and 165 and the gate insulating layer 140.

The data lines 171 transmit data signals and extend substantially in the longitudinal direction to intersect the gate lines 121. Each data line 171 includes a plurality of source electrodes 173 projecting toward the gate electrodes 124 and curved like a character J and an end portion 179 having a large area for contact with another layer or an external driving circuit. The drain electrodes 175 are separated from the data lines 171 and disposed opposite the source electrodes 173 with respect to the gate electrodes 124.

The data lines 171 and the drain electrodes 175 may be made of a refractory metal such as Cr, Mo, Ta, Ti, or alloys thereof. However, they may have a multi-layered structure including a refractory metal film (not shown) and a low resistivity film (not shown). Good examples of the multi-layered structure are a double-layered structure including a lower Cr/Mo (alloy) film and an upper Al (alloy) film, and a triple-layered structure of a lower Mo (alloy) film, an intermediate Al (alloy) film, and an upper Mo (alloy) film. However, the data lines 171 and the drain electrodes 175 may be made of various metals or conductors.

A gate electrode 124, a source electrode 173, and a drain electrode 175 along with a projection 154 of a semiconductor stripe 151 form a TFT having a channel formed in the projection 154 disposed between the source electrode 173 and the drain electrode 175.

The ohmic contacts 161 and 165 are interposed only between the underlying semiconductor stripes 151 and the overlying conductors 171 and 175 thereon, and reduce the contact resistance therebetween.

Although the semiconductor stripes 151 are narrower than the data lines 171 at most places, the width of the semiconductor stripes 151 becomes large near the gate lines 121 as described above, to smooth the profile of the surface, thereby preventing disconnection of the data lines 171. However, the semiconductor stripes 151 include some exposed portions, which are not covered with the data lines 171 and the drain electrodes 175, such as portions located between the source electrodes 173 and the drain electrodes 175.

A passivation layer 180 is formed on the data lines 171, the drain electrodes 175, and the exposed portions of the semiconductor stripes 151. The passivation layer 180 may be made of an inorganic insulator or organic insulator and it may have a flat top surface. Examples of the inorganic insulator include silicon nitride and silicon oxide. The organic insulator may have photosensitivity and a dielectric constant of less than about 4.0. The passivation layer 180 may include a lower film of an inorganic insulator and an upper film of an organic insulator, such that it takes the excellent insulating characteristics of the organic insulator while preventing the exposed portions of the semiconductor stripes 151 from being damaged by the organic insulator.

The passivation layer 180 has a plurality of contact holes 181, 182, and 185 exposing the end portions 129 of the gate lines 121, the end portions 179 of the data lines 171, and the drain electrodes 175, respectively.

A plurality of pixel electrodes 190 and a plurality of contact assistants 81 and 82 are formed on the passivation layer 180. They are preferably made of a transparent conductor such as ITO or IZO or a reflective conductor such as Ag, Al, and alloys thereof.

The pixel electrodes 190 are physically and electrically connected to the drain electrodes 175 through the contact holes 185 such that the pixel electrodes 191 receive data voltages from the drain electrodes 175 and supply the data voltages to respective electrophoretic members 300.

The contact assistants 81 and 82 are connected to the end portions 129 of the gate lines 121 and the end portions 179 of the data lines 171 through the contact holes 181 and 182, respectively. The contact assistants 81 and 82 protect the end portions 129 and 179 and enhance the adhesion between the end portions 129 and 179 and external devices such as a driver integrated circuit.

A plurality of partitioning walls 195 are formed on the passivation layer 180. They include at least one of an organic insulator material and an inorganic insulator material and separate each of the pixel electrodes 190. The partitioning walls 191 surround the peripheries of the pixel electrodes 190 to define pixel areas where a dispersion medium 312 of the electrophoretic member 300 is filled.

The pixel areas A include four adjacent pixel areas A1, A2, A3, and A4 disposed at the top, bottom, right, and left thereof, respectively.

Next, the common electrode panel 200 will be described.

The common electrode panel 200 is opposed to the thin film transistor array panel 100, and includes a transparent insulation substrate 210 and a common electrode 270 formed on the insulation substrate 210.

The common electrode 270 is a transparent electrode made of ITO or IZO, and applies a common voltage to respective electrophoretic particles 314 and 316 of the electrophoretic members 300.

The common electrode 270 that applies a common voltage changes the position of the electrophoretic particles 312 and 314 by applying a driving voltage to the respective electrophoretic particles 312 and 314 along with the pixel electrodes 190 that apply a data voltage, thereby displaying images of desired black and white luminance or colors.

Next, the electrophoretic members 300 located in respective pixel areas A will be described.

The respective electrophoretic members 300 include a transparent dispersion medium 312 and a plurality of first electrophoretic particles 314 and a plurality of second electrophoretic particles 316 dispersed in the dispersion medium 312.

The first electrophoretic particles 314 are electrification particles that have a white color for reflecting external light to show a white color, and have negative charges. The second electrophoretic particles 316 are electrification particles that have a black color for absorbing external light to show a black color, and have positive charges. Further, the first electrophoretic particles 314 and the second electrophoretic particles 316 may have positive charges and negative charges, respectively, contrary to the above.

Now, a method for displaying images having four different gray levels of the electrophoretic display according to an embodiment of the present invention will be described with reference to FIG. 3 and FIG. 4.

Figure 4:
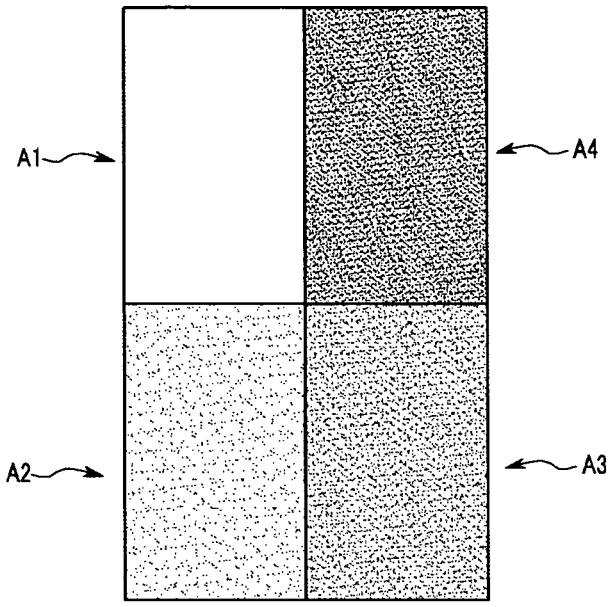
FIG. 4 is a plan view representing images displayed at four pixel areas of the electrophoretic display shown in FIG. 3.

FIG. 3 is a sectional view of the electrophoretic display shown in FIG. 1 taken along the line III-III, and FIG. 4 is a plan view representing images displayed at four pixel areas of the electrophoretic display shown in FIG. 3.

The driving voltages are the difference between the common voltage applied to the common electrode 270 and the data voltages applied to respective pixel electrodes 190. The data voltages applied to the electrophoretic particles 314 and 316 of respective pixel areas A1, A2, A3, and A4 and have different durations and cause the electrophoretic particles 314 and 316 of the respective pixel areas A1, A2, A3, and A4 to be arranged as shown in FIG. 3.

The first electrophoretic particles 314 of the first pixel area A1 are positioned adjacent to the common electrode 270, and the second electrophoretic particles 316 are positioned adjacent to the pixel electrodes 190. Accordingly, most external light incident to the first pixel area A1 is reflected from the first electrophoretic particles 314 having a white color. Thereby, the first pixel area A1 displays a third gray (maximum gray scale) image of white that is the brightest, as shown in FIG. 4.

The first and second electrophoretic particles 314 and 316 of the second pixel area A2 are positioned between the pixel electrodes 190 and the common electrode 270, and most the first electrophoretic particles 314 are arranged adjacent to the common electrode 270. Accordingly, a large quantity of external light incident to the second pixel area A2 is reflected from the first electrophoretic particles 314 having a white color, and a small quantity of external light incident to the second pixel area A2 is absorbed in the second electrophoretic particles 316 having a black color. Thereby, the second pixel area A2 displays a second gray (middle gray scale) image that is darker than the first gray (middle gray scale) image, as shown in FIG. 4.

The first and second electrophoretic particles 314 and 316 of the third pixel area A3 are positioned between the pixel electrodes 190 and the common electrode 270, and most the second electrophoretic particles 316 are arranged adjacent to the common electrode 270. Accordingly, a small quantity of external light incident to the third pixel area A3 is reflected from the first electrophoretic particles 314 having a white color, and a large quantity of external light incident to the third pixel area A3 is absorbed in the second electrophoretic particles 316 having a black color. Thereby, the third pixel area A3 displays a first gray image that is darker than the second gray image, as shown in FIG. 4.

The first electrophoretic particles 314 of the fourth pixel area A4 are arranged adjacent to the pixel electrodes 190, and the second electrophoretic particles 316 are arranged adjacent to the common electrode 270. Accordingly, most external light incident to the fourth pixel area A4 is absorbed in the second electrophoretic particles 316 having a black color. Thereby, the fourth pixel area A4 displays a zeroth gray (minimum gray scale) image of black that is the darkest, as shown in FIG. 4.

The electrophoretic particles 314 and 316 of the respective pixel areas A1, A2, A3, and A4 may be variously arranged such that the respective pixel areas A1, A2, A3, and A4 may display one gray image of the four gray images described above. Accordingly, the electrophoretic display may display desired images by a combination of the four gray images described above.

Hereinafter, a driving method for the electrophoretic display according to an embodiment of the present invention will be described referring to FIG. 5 to FIG. 15.

Figure 5:
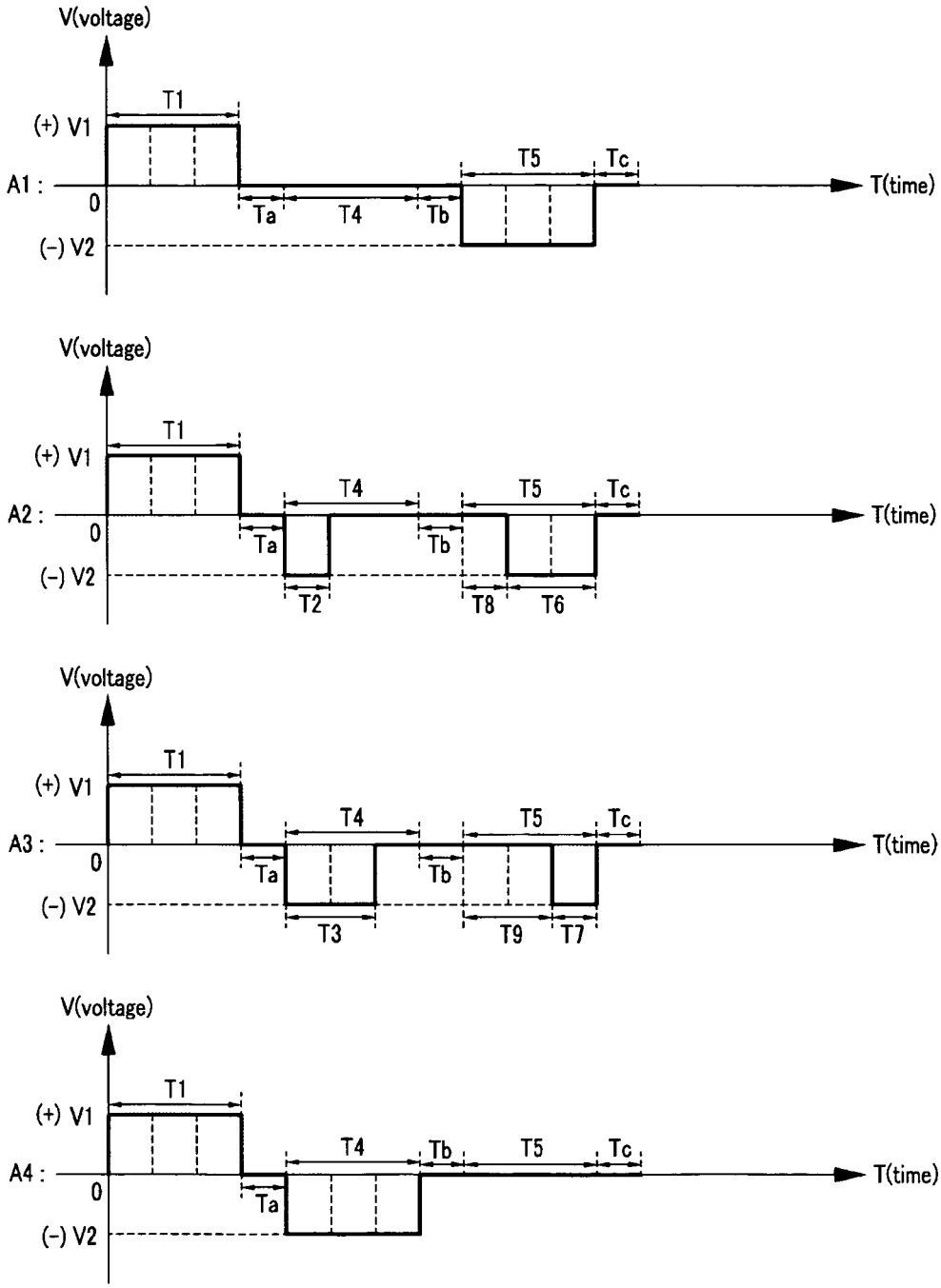
FIG. 5 is a drawing representing driving voltages supplied to four pixel areas of the electrophoretic display with respect to time for explaining a method for driving the electrophoretic display according to an embodiment of the present invention.
Figure 6:
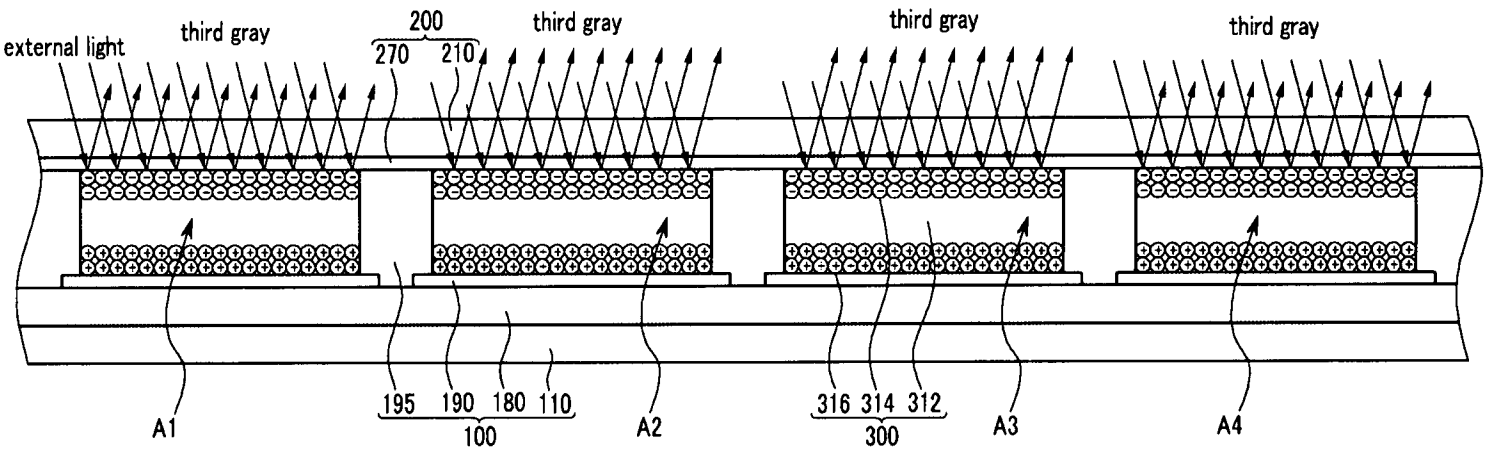
FIG. 6 and FIG. 7 are a sectional view of the four pixel areas and a plan view representing images displayed at the four pixel areas after a first time has passed in FIG. 5, respectively.
Figure 7:
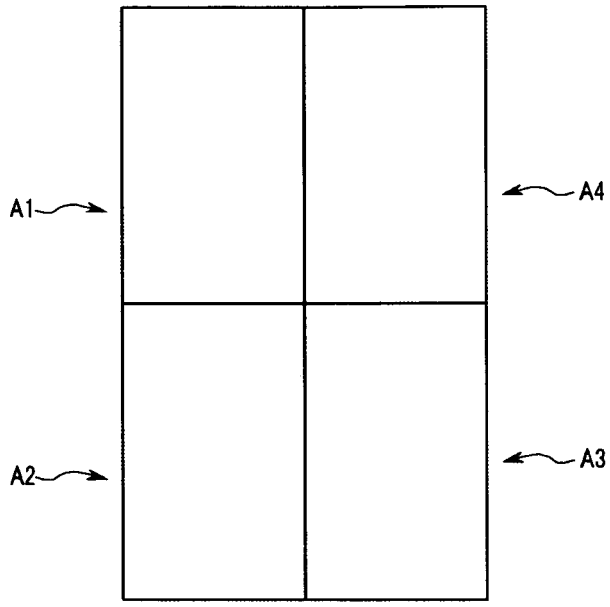
Figure 8:
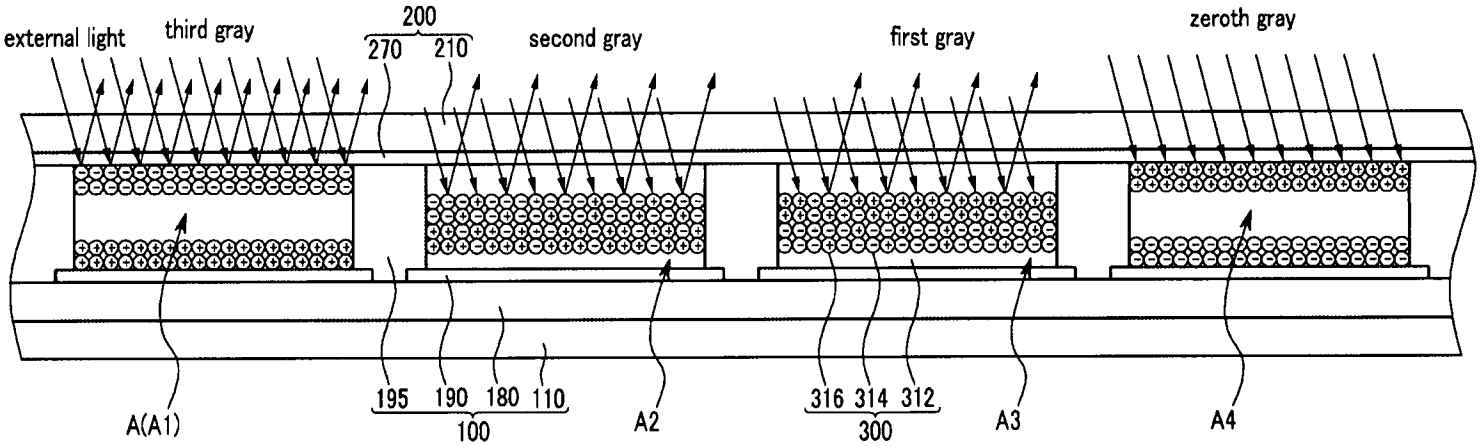
FIG. 8 and FIG. 9 are a sectional view of the four pixel areas and a plan view representing images displayed at the four pixel areas after a fourth time has passed in FIG. 5, respectively.
Figure 9:
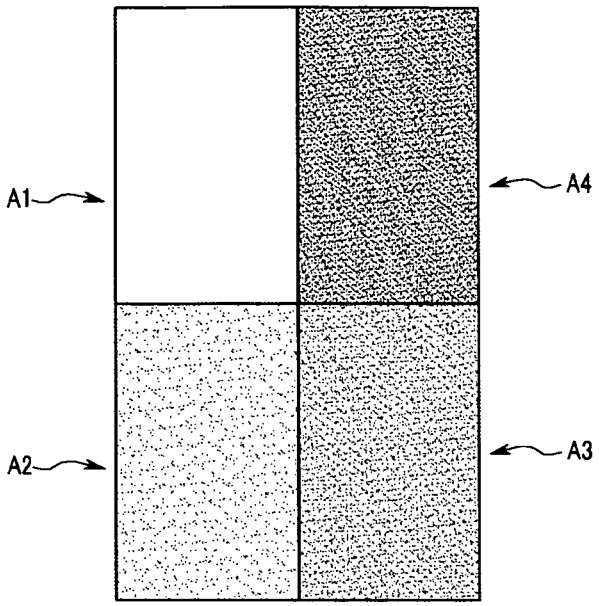
Figure 10:
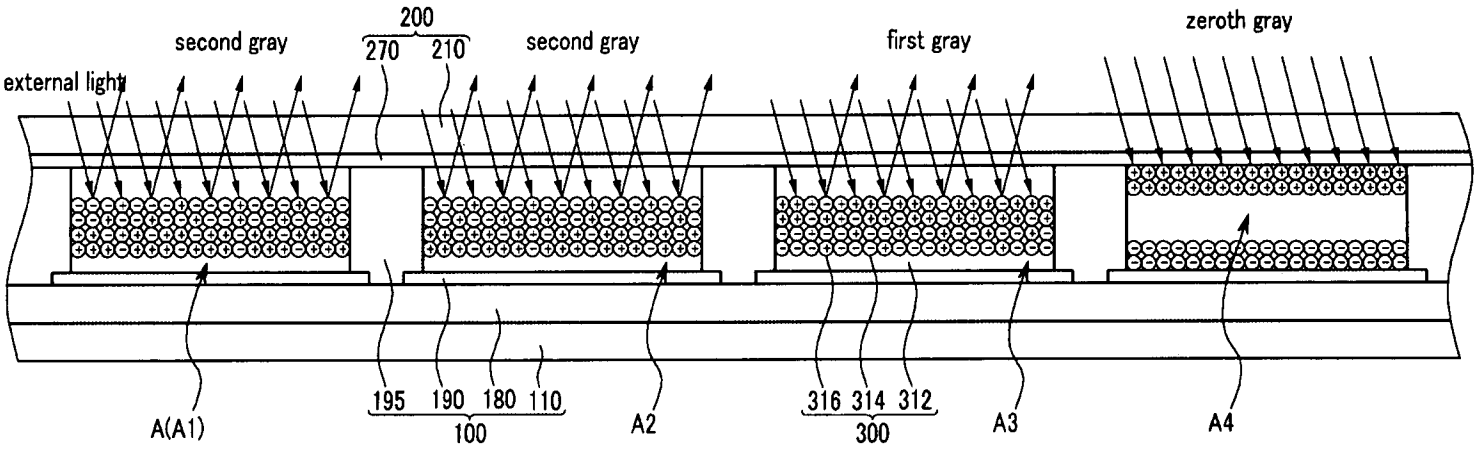
FIG. 10 and FIG. 11 are a sectional view of the four pixel areas and a plan view representing images displayed at the four pixel areas after a eighth time has passed in FIG. 5, respectively.
Figure 11:
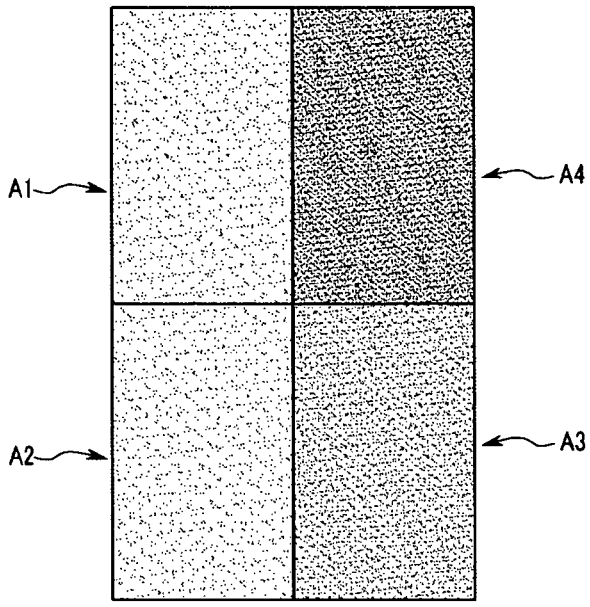
Figure 12:
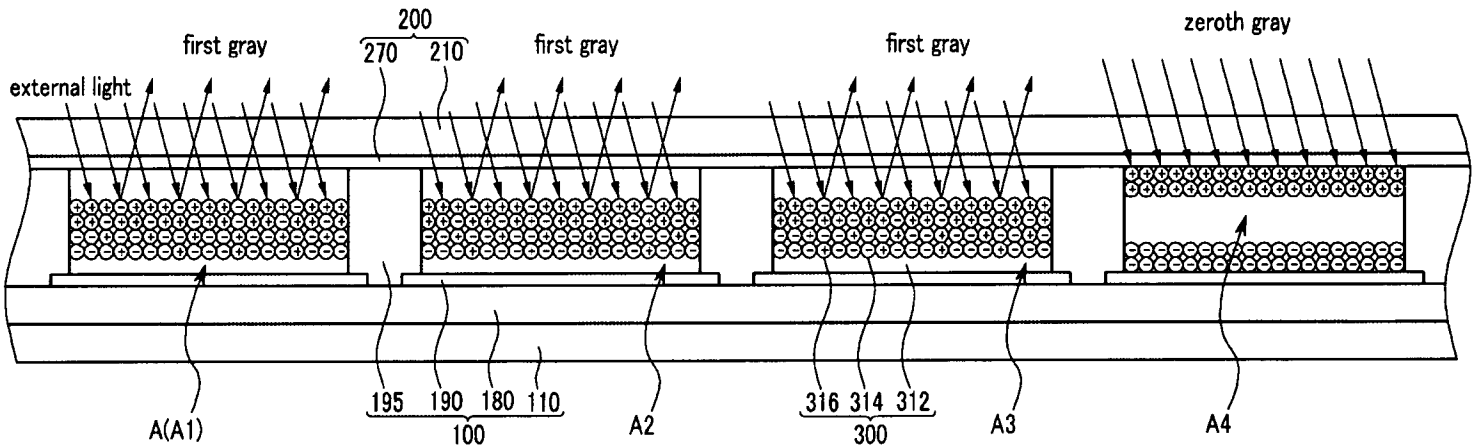
FIG. 12 and FIG. 13 are a sectional view of the four pixel areas and a plan view representing images displayed at the four pixel areas after a ninth time has passed in FIG. 5, respectively.
Figure 13:
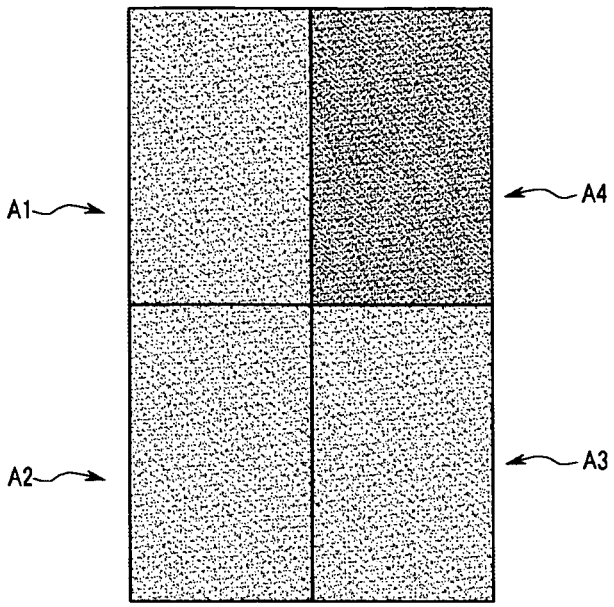
Figure 14:
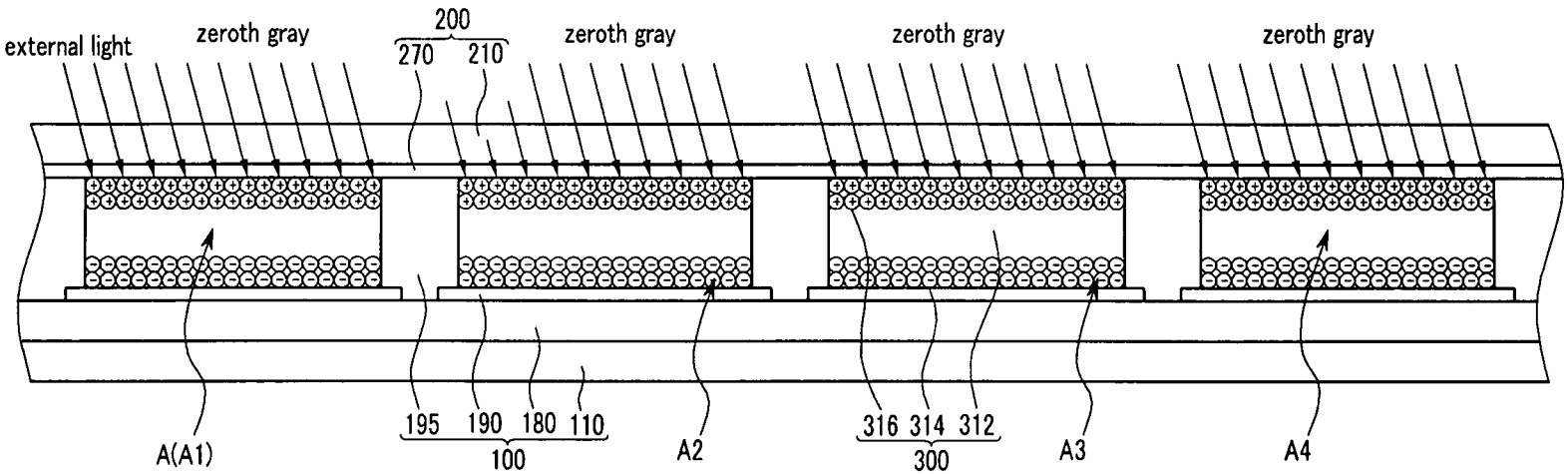
FIG. 14 and FIG. 15 are a sectional view of the four pixel areas and a plan view representing images displayed at the four pixel areas after a fifth time has passed in FIG. 5, respectively.
Figure 15:
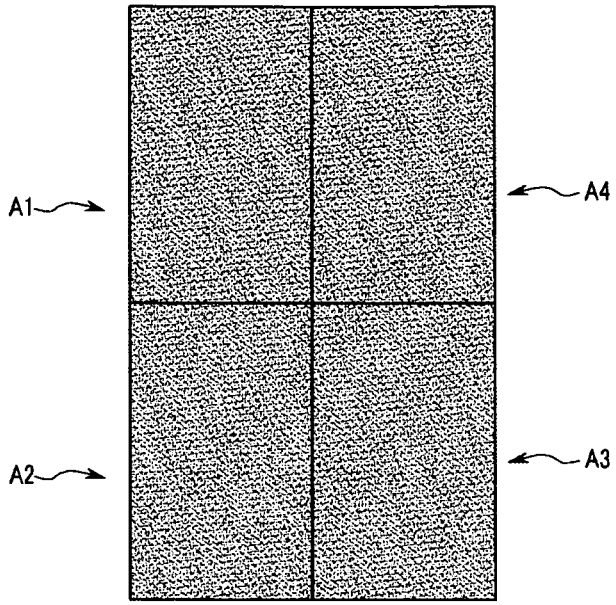

FIG. 5 is a drawing representing driving voltages supplied to four pixel areas of the electrophoretic display with respect to time for explaining a method of driving the electrophoretic display according to an embodiment of the present invention. FIG. 6 and FIG. 7 are a sectional view of the four pixel areas and a plan view representing images displayed at the four pixel areas after a first time has passed in FIG. 5, respectively, FIG. 8 and FIG. 9 are a sectional view of the four pixel areas and a plan view representing images displayed at the four pixel areas after a fourth time has passed in FIG. 5, respectively, FIG. 10 and FIG. 11 are a sectional view of the four pixel areas and a plan view representing images displayed at the four pixel areas after a eighth time has passed in FIG. 5, respectively, FIG. 12 and FIG. 13 are a sectional view of the four pixel areas and a plan view representing images displayed at the four pixel areas after a ninth time has passed in FIG. 5, respectively, and FIG. 14 and FIG. 15 are a sectional view of the four pixel areas and a plan view representing images displayed at the four pixel areas after a fifth time has passed in FIG. 5, respectively.

In addition, the value of the driving voltage in FIG. 5 is obtained by subtracting the data voltage applied to the pixel electrode from the common voltage applied to the common voltage, which is defined as follows.

The initial driving voltage V1 is a positive (+) voltage that allows the first electrophoretic particles 314 to overcome fluid resistance caused by the dispersion medium 312 and move to the common electrode 270, and allows the second electrophoretic particles 316 to overcome fluid resistance caused by the dispersion medium 312 and move to the pixel electrodes 190.

The first image-displaying voltage and the first constant gray-displaying voltage V2 are negative (−) voltages that allow the first electrophoretic particles 314 to overcome fluid resistance caused by the dispersion medium 312 and move to the pixel electrodes 190, and allow the second electrophoretic particles 316 to overcome fluid resistance caused by the dispersion medium 312 and move to the common electrode 270. The first image-displaying voltage and the first constant gray-displaying voltage V2 have substantially the same value and the opposite polarity to that of the initial driving voltage V1. The polarity of the voltages V1 and V2 may be opposite to that described above.

In addition, applying times of the voltages V1 and V2 of FIG. 5 are defined as follows. The applying time is denoted as additional Arabic numbers and the magnitude of the small number does not represent a length of time or an order.

The first time T1 is the time needed for the first electrophoretic particles 314 and the second electrophoretic particles 316 to move adjacent to the common electrode 270 and the pixel electrodes 190, respectively, by applying the driving voltage V1.

The second time T2 is a time needed for the first electrophoretic particles 314 and the second electrophoretic particles 316 adjacent to the common electrode 270 and the pixel electrodes 190, respectively to move between the pixel electrodes 190 and the common electrode 270 by applying the first image-displaying voltage V2. Most the first electrophoretic particles 314 are disposed adjacent to the common electrode 270, and the length of the second time T2 may be about one third of that of a fourth time T4.

The third time T3 is a time needed for the first electrophoretic particles 314 and the second electrophoretic particles 316 adjacent to the common electrode 270 and the pixel electrodes 190, respectively to move between the pixel electrodes 190 and the common electrode 270 by applying the first image-displaying voltage V2. Most the second electrophoretic particles 316 are disposed adjacent to the common electrode 270, and the length of the third time T3 may be about two thirds of that of the fourth time T4.

The fourth time T4 is a time needed for the first electrophoretic particles 314 and the second electrophoretic particles 316 adjacent to the common electrode 270 and the pixel electrodes 190, respectively, to move to the pixel electrodes 190 and the common electrode 270, respectively. The length of the fourth time T4 may be substantially the same as that of the first time T1.

The fifth time T5, the sixth time T6, and the seventh time T7 are times needed for the first electrophoretic particles 314 and the second electrophoretic particles 316 to move with respect to the pixel electrodes 190 and the common electrode 270, respectively by applying the first constant gray-displaying voltage V2. The fifth time T5, the sixth time T6, and the seventh time T7 have substantially the same lengths as the fourth time T4, the third time T3, and the second time T2, respectively.

The eighth time T8 and the ninth time T9 have the substantially the same lengths as the seventh time T7 and the sixth time T6, respectively.

Time Ta, Tb, and Tc are times for not applying voltages V1 and V2. The times Ta, Tb, and Tc may be the same or different, and may be omitted.

In the driving method for the electrophoretic display according to an embodiment of the present invention, the initial driving voltage V1 is applied to the electrophoretic particles 314 and 316 positioned in the first to fourth pixel areas A1, A2, A3, and A4 for the first time T1 such that the first to fourth pixel areas A1, A2, A3, and A4 display initial image as shown in FIG. 5.

Accordingly, the first electrophoretic particles 314 positioned in the first to fourth pixel areas A1, A2, A3, and A4 are moved and arranged to the common electrode 270 and the second electrophoretic particles 316 positioned in the first to fourth pixel areas A1, A2, A3, and A4 move to the pixel electrodes 190 as shown in FIG. 6.

Because of the arrangement of the electrophoretic particles 314 and 316, an external light incident on the electrophoretic display is reflected from the first electrophoretic particles 314.

As shown in FIG. 7, the first to fourth pixel areas A1, A2, A3, and A4 display the third gray images that are the brightest.

Next, after the first time T1 and the predetermined time Ta, the first image-displaying voltage V2 is applied to the electrophoretic particles 314 and 316 positioned in the second to fourth pixel areas A2, A3, and A4 for the fourth times T2, T3, and T4, respectively, as shown in FIG. 5. Here, the first image-displaying voltage V2 is not applied to the first pixel area A1.

The first electrophoretic particles 314 and the second electrophoretic particles 316 positioned in the first to fourth pixel areas A1, A2, A3, and A4 are thereby arranged as shown in FIG. 8.

Because of the arrangement of the electrophoretic particles 314 and 316 shown in FIG. 8, the first pixel area A1 displays the third gray image that is the brightest, and the second pixel areas A2 displays the second gray image that is darker than the third gray image, as shown in FIG. 9. In addition, the third pixel area A3 displays the first gray image that is darker than the second gray image, and the fourth pixel area A4 displays the zeroth gray image that is the darkest as shown in FIG. 9.

In the present embodiment, though the first to fourth pixel areas A1, A2, A3, and A4 display the third gray image, the second gray image, the first gray image, and the zeroth gray image, respectively, the respective pixel areas A1, A2, A3, and A4 may display any one gray image of the zeroth gray image, the first gray image, the second gray image, and the third gray image. Accordingly, the entirety of the pixel areas A may display desired images by a combination of the four gray images.

Next, as shown in FIG. 5, after the fourth time T4 and a predetermined time Tb, the first constant gray-displaying voltage V2 is applied to respective electrophoretic particles 314 and 316 positioned in the first to third pixel areas A1, A2, and A3 for the fifth time T5 to the seventh time T7, as shown in FIG. 5. Here, the first constant gray-displaying voltage V2 is not applied to the fourth pixel area A4.

Electrophoretic particles 314 and 316 positioned in the second pixel area A2 may preferably be supplied with the first constant gray-displaying voltage V2 for the sixth time T6 after the predetermined time Tb and the eighth time T8. In addition, respective electrophoretic particles 314 and 316 positioned in the third pixel area A3 may preferably be supplied with the first constant gray-displaying voltage V2 for the seventh time T7 after the predetermined time Tb and the ninth time T9.

Accordingly, after the eighth time T8 of the fifth time T5, the first electrophoretic particles 314 and the second electrophoretic particles 316 positioned in the first to fourth pixel areas A1, A2, A3, and A4 are arranged as shown in FIG. 10.

Because of the arrangement of the electrophoretic particles 314 and 316 as shown in FIG. 10, the first pixel area A1 and the second pixel area A2 display the second gray image, the third pixel area A3 displays the first gray image that is darker than the second gray, and the fourth pixel area A4 displays the zeroth gray image of the darkest as shown in FIG. 11. In comparison with images displayed in FIG. 9, the first pixel area A1 is changed to display the second gray image from the third gray image.

After the ninth time T9 of the fifth time T5, the first electrophoretic particles 314 and 316 positioned in the first to fourth pixel areas A1, A2, A3, and A4 are arranged as shown in FIG. 12.

Because of the arrangement of the electrophoretic particles 314 and 316 as shown in FIG. 12, the first pixel area A1, the second pixel area A2, and the third pixel area A3 display the first gray image, and the fourth pixel area A4 displays the zeroth gray image that is the darkest, as shown in FIG. 13. In comparison with images displayed in FIG. 11, the first pixel area A1 and the second pixel area A2 are changed to display the first gray images from the second gray images.

After the entire fifth time T5, the first electrophoretic particles 314 and 316 positioned in the first to fourth pixel areas A1, A2, A3, and A4 are arranged as shown in FIG. 14.

Accordingly, the first to fourth pixel areas A1, A2, A3, and A4 display the zeroth gray image that is the darkest as shown in FIG. 15. In comparison with the images displayed in FIG. 13, the first pixel area A1 to the third pixel area A3 are changed to display the zeroth gray images from the first gray images.

As described above, the electrophoretic particles 314 and 316 of the second pixel area A2 are supplied with the first constant gray-displaying voltage V2 for the sixth time T6 after the eighth time T8 of the fifth time T5, and the electrophoretic particles 314 and 316 of the third pixel area A3 are supplied with the first constant gray-displaying voltage V2 for the seventh time T7 after the ninth time T9 of the fifth time T5, and thereby the first pixel area A1 to the third pixel area A3 are gradually changed to display the zeroth gray image that is the darkest without display performance deterioration of the electrophoretic display.

In addition, the electrophoretic particles 314 and 316 positioned in the respective pixel areas A1, A2, A3, and A4 are supplied with the positive driving voltage and the negative driving voltage for the same period in total, and thereby the pixel electrodes 190 of the respective pixel areas A1, A2, A3, and A4 are refreshed to prevent incidental images.

The driving process described above is repeated after a predetermined time Tc for displaying a desired image and preventing incidental images.

The driving method for the electrophoretic display according to an embodiment of the present invention described above will be summarized briefly as follows.

Referring to FIG. 5, the initial driving voltage V1 is applied to the electrophoretic particles 314 and 316 of the respective pixel areas A1, A2, A3, and A4 for the first time T1, then the first image-displaying voltage V2 is supplied to the electrophoretic particles 314 and 316 of the second to fourth pixel areas A2, A3, and A4 for the time T2, T3, and T4, respectively, and then the first constant gray-displaying voltage V2 is supplied to the electrophoretic particles 314 and 316 of the first to third pixel areas A1, A2, and A3 for the time T5, T6, and T7, respectively.

The first image-displaying voltage V2 and the first constant gray-displaying voltage V2 have the same value and polarity, and the initial driving voltage V1 has the same magnitude and the opposite polarity to that of the first image-displaying voltage V2 and the first constant gray-displaying voltage V2.

Accordingly, the integrated time of applying the initial driving voltage V1 is substantially the same as that of applying the first image-displaying voltage V2 and the first constant gray-displaying voltage V2 to the respective pixel areas A to refresh the pixel electrodes 190 of the respective pixel areas A.

The present embodiment may be modified within the condition that the integrated time of applying the initial driving voltage and that of applying the first image-displaying voltage V2 and the first constant gray-displaying voltage V2 are substantially the same.

According to the known driving method for an electrophoretic display, a driving voltage is continuously applied to a pixel area for a predetermined period, and then a reversed driving voltage, that has the same value and opposite polarity to that of the driving voltage, is continuously applied to the pixel area for the same time.

However, according to the driving method for the electrophoretic display according to an embodiment of the present invention, the first pixel area A1 to the third pixel area A3 are gradually changed to smoothly display the zeroth gray image that is the darkest to improve display performance of the electrophoretic display.

The first to fourth pixel areas A1, A2, A3, and A4 may be changed with each other.

Hereinafter, a driving method for the electrophoretic display according to another embodiment of the present invention will be described referring to FIG. 16 to FIG. 24.

Figure 16:
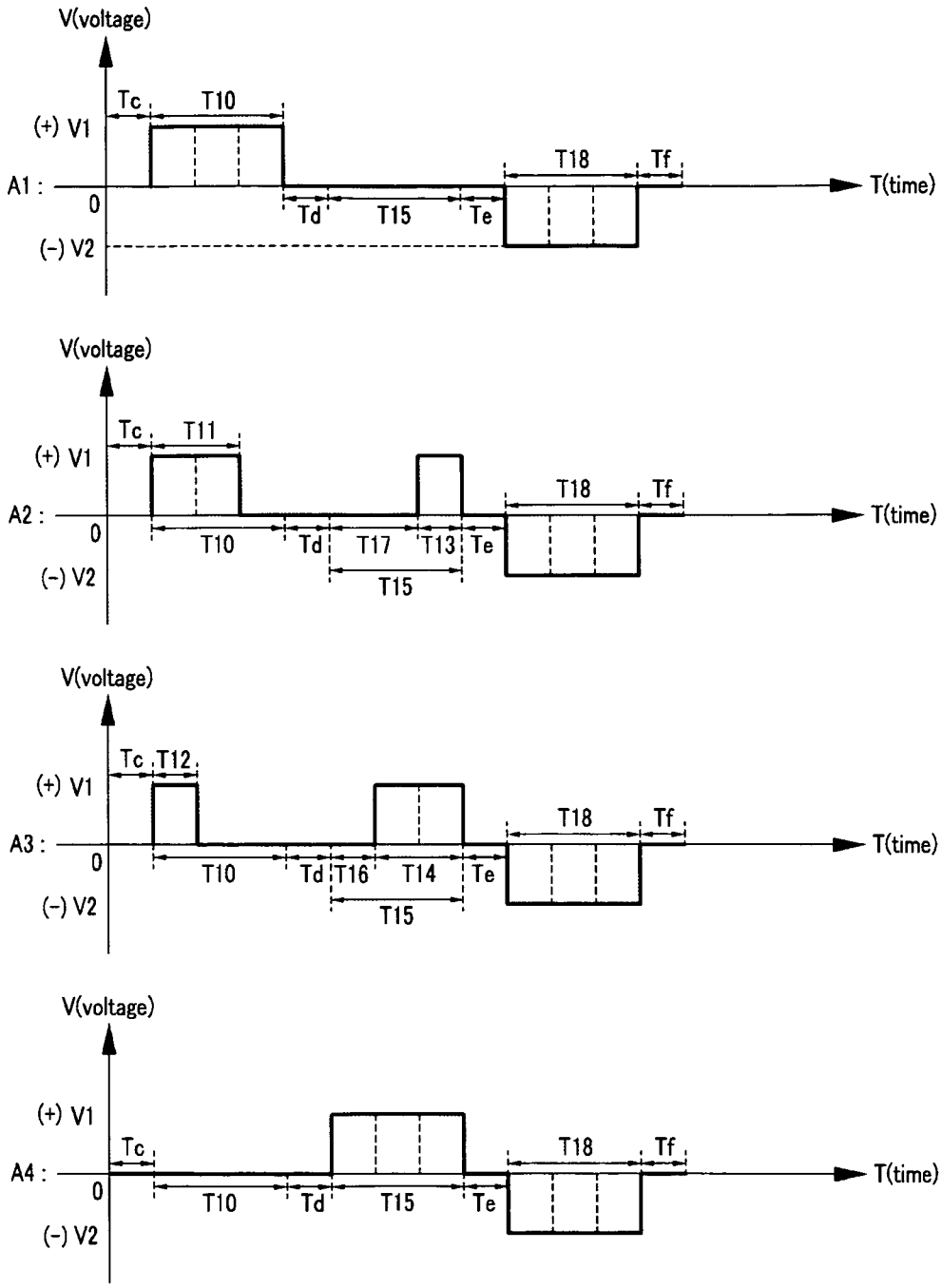
FIG. 16 is a drawing representing driving voltages supplied to four pixel areas of the electrophoretic display with respect to time for explaining a method for driving the electrophoretic display according to another embodiment of the present invention.
Figure 17:
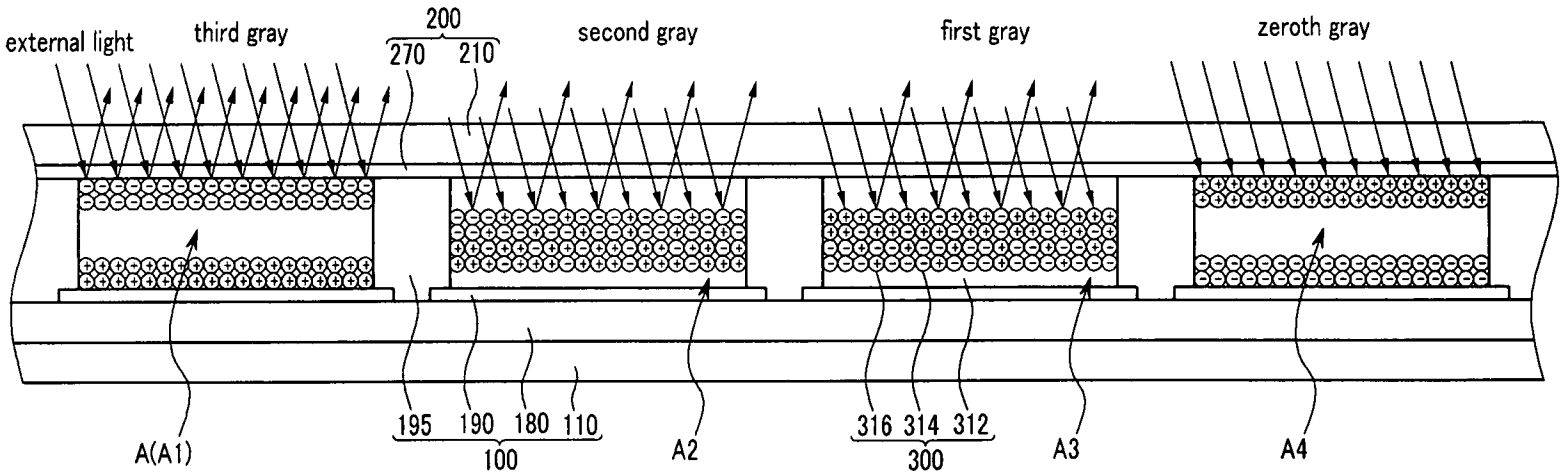
FIG. 17 and FIG. 18 are a sectional view of the four pixel areas and a plan view representing images displayed at the four pixel areas after a tenth time has passed in FIG. 16, respectively.
Figure 18:
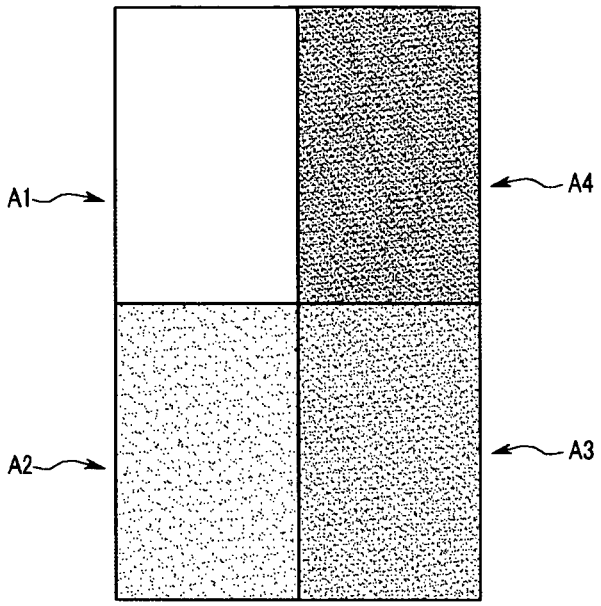
Figure 19:
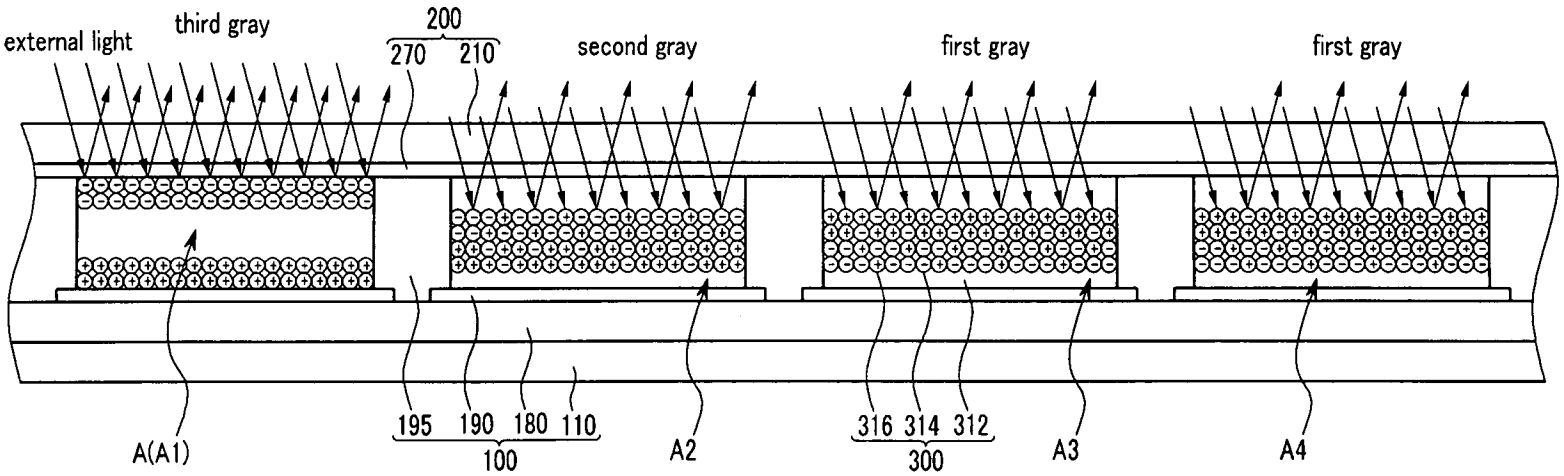
FIG. 19 and FIG. 20 are a sectional view of the four pixel areas and a plan view representing images displayed at the four pixel areas after a sixteenth time has passed in FIG. 16, respectively.
Figure 20:
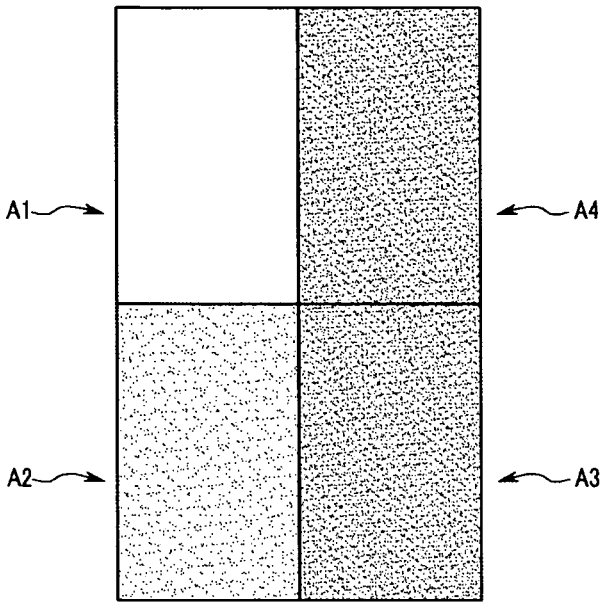
Figure 21:
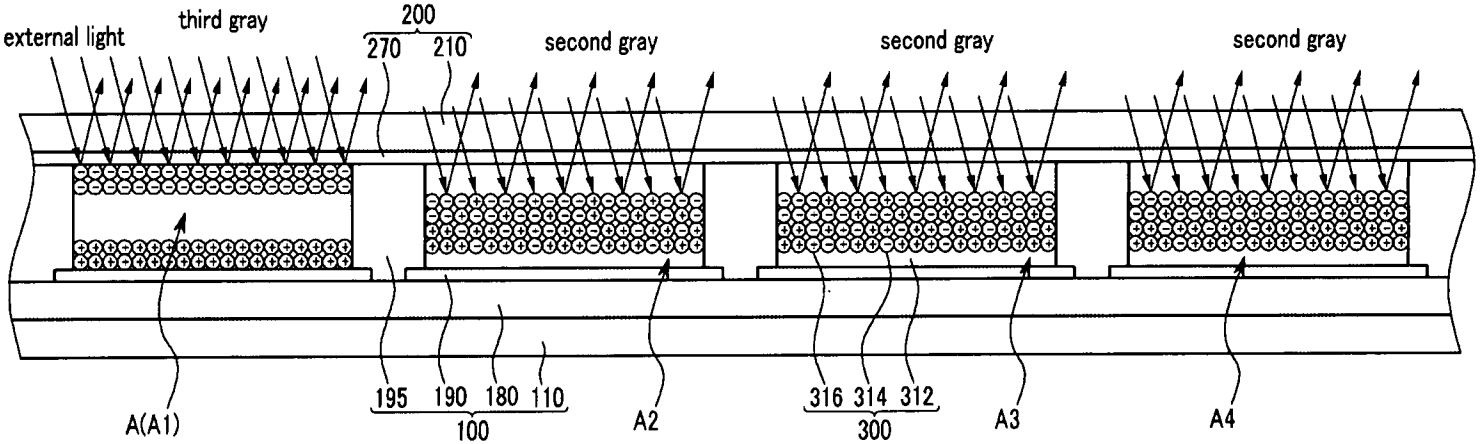
FIG. 21 and FIG. 22 are a sectional view of the four pixel areas and a plan view representing images displayed at the four pixel areas after a seventeenth time has passed in FIG. 16, respectively.
Figure 22:
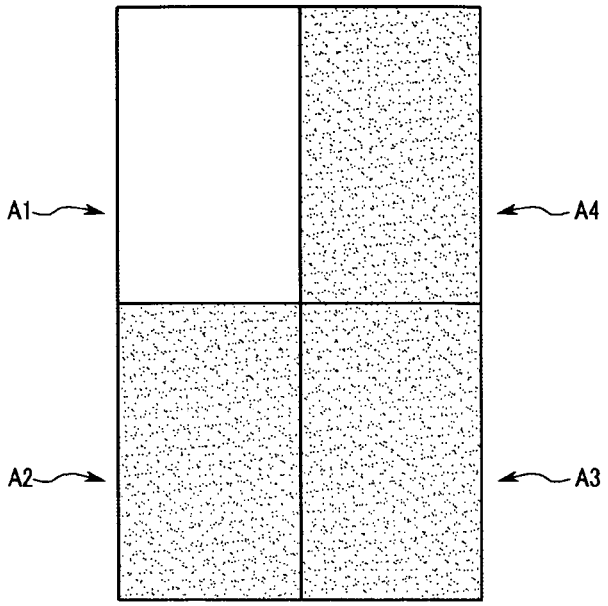
Figure 23:
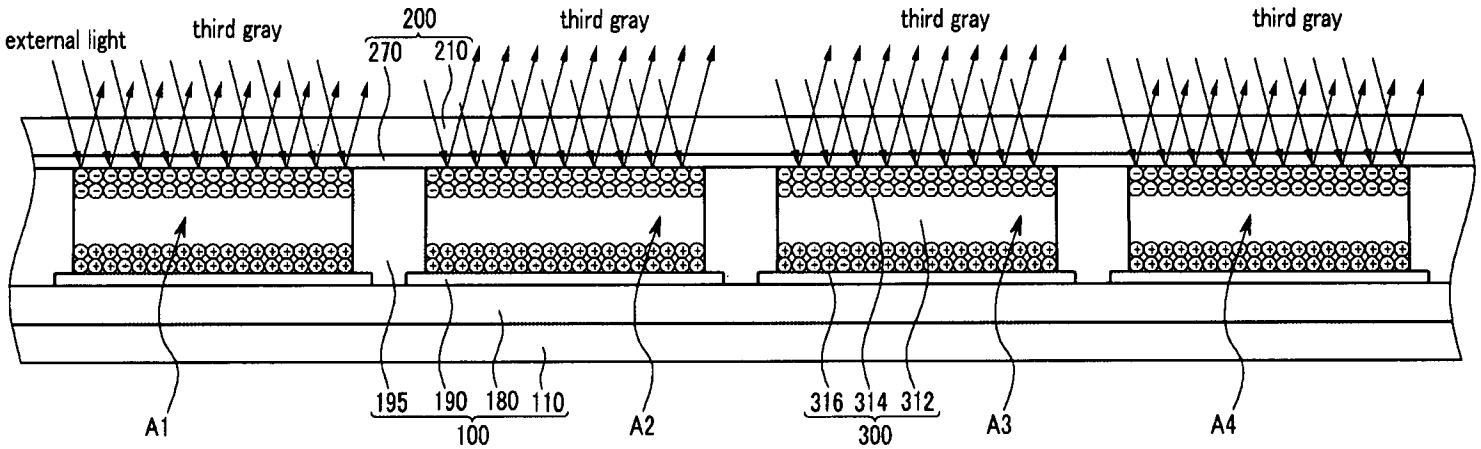
FIG. 23 and FIG. 24 are a sectional view of the four pixel areas and a plan view representing images displayed at the four pixel areas after a fifteenth time has passed in FIG. 16, respectively.
Figure 24:
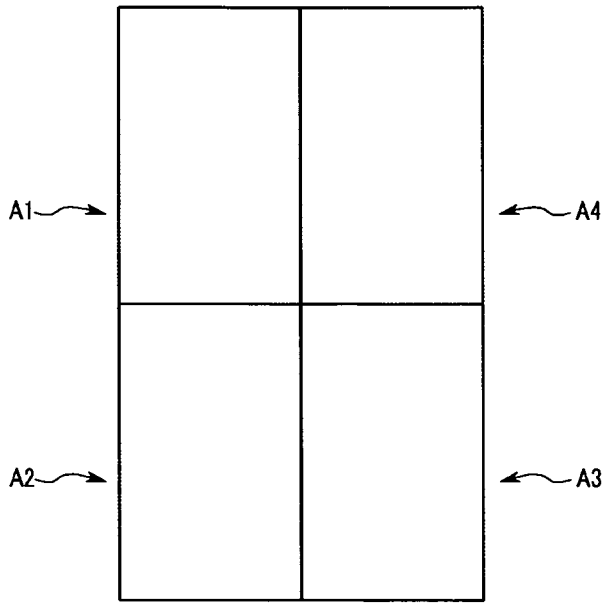

FIG. 16 is a drawing representing driving voltages supplied to four pixel areas of the electrophoretic display with respect to time for explaining a method for driving the electrophoretic display according to another embodiment of the present invention. FIG. 17 and FIG. 18 are a sectional view of the four pixel areas and a plan view representing images displayed at the four pixel areas after a tenth time has passed in FIG. 16, respectively, FIG. 19 and FIG. 20 are a sectional view of the four pixel areas and a plan view representing images displayed at the four pixel areas after a sixteenth time has passed in FIG. 16, respectively, FIG. 21 and FIG. 22 are a sectional view of the four pixel areas and a plan view representing images displayed at the four pixel areas after a seventeenth time has passed in FIG. 16, respectively, and FIG. 23 and FIG. 24 are a sectional view of the four pixel areas and a plan view representing images displayed at the four pixel areas after a fifteenth time has passed in FIG. 16, respectively.

The driving voltage to be mentioned with respect to FIG. 16 is a value obtained by subtracting a data voltage applied to the pixel electrode from a common voltage applied to the common voltage, which is defined as follows.

The second image-displaying voltage V1 and the second constant gray-displaying voltage V1 are positive (+) voltages that allow the first electrophoretic particles 314 to overcome fluid resistance caused by the dispersion medium 312 and move to the common electrode 270, allow the second electrophoretic particles 316 to overcome fluid resistance caused by the dispersion medium 312 and move to the pixel electrodes 190, and have substantially the same value as the initial driving voltage V1.

The compensation voltage V2 is a negative (−) voltage that allows the first electrophoretic particles 314 to overcome fluid resistance caused by the dispersion medium 312 and move to the pixel electrodes 190, allows the second electrophoretic particles 316 to overcome fluid resistance caused by the dispersion medium 312 and move to the common electrode 270, and has substantially the same value and the opposite polarity to that of the first image-displaying voltage and the first constant gray-displaying voltage V2.

In addition, applying times of the voltages V1 and V2 to be mentioned with respect to FIG. 16 are defined as follows. The applying time is denoted as additional Arabic number, and the magnitude of the number does not represent a length of time or an order.

The tenth time T10 is a time needed for the first electrophoretic particles 314 and the second electrophoretic particles 316, which are respectively arranged adjacent to the pixel electrodes 190 and the common electrode 270, to move and be arranged adjacent to the common electrode 270 and the pixel electrodes 190, respectively, by applying the second image-displaying voltage V1.

The eleventh time T11 is a time needed for the first electrophoretic particles 314 and the second electrophoretic particles 316, which are respectively adjacent to the pixel electrodes 190 and the common electrode 270, to move and be arranged adjacent to the common electrode 270 and the pixel electrodes 190, respectively by applying the second image-displaying voltage V1. Most of the first electrophoretic particles 314 are disposed adjacent to the common electrode 270, and the length of the eleventh time T11 may be two thirds that of the tenth time T10.

The twelfth time T12 is a time needed for the first electrophoretic particles 314 and the second electrophoretic particles 316, which are respectively arranged adjacent to the pixel electrodes 190 and the common electrode 270, to move and be arranged adjacent to the common electrode 270 and the pixel electrodes 190, respectively, by applying the second image-displaying voltage V1. Most of the second electrophoretic particles 316 are disposed adjacent to the common electrode 270, and the length of the twelfth time T12 may be one third that of the tenth time T10.

The thirteenth time T13, the fourteenth time T14, and the fifteenth time T15 are times needed for the first electrophoretic particles 314 and the second electrophoretic particles 316 to move and be arranged adjacent to the common electrode 270 and the pixel electrodes 190, respectively, by applying the second constant gray-displaying voltage V1, and respectively have substantially the same lengths as the twelfth time T12, the eleventh time T11, and the tenth time T10.

The sixteenth time T16 and the seventeenth time T17 are times that have substantially the same lengths as the thirteenth time T13 and the fourteenth time T14, respectively.

The eighteenth time T18 is a time needed for the first electrophoretic particles 314 and the second electrophoretic particles 316, which are respectively arranged adjacent to the common electrode 270 and the pixel electrodes 190, to move and be arranged adjacent to the pixel electrodes 190 and the common electrode 270, respectively, by applying the compensation voltage V2, and has substantially the same length as the tenth time T10.

Times Td, Te, and Tf are times for not applying voltages V1 and V2. The times Td, Te, and Tf may be the same or different, and may be omitted.

The driving method shown in FIG. 16 may be the same as the driving method shown in FIG. 5 until the fifth time T5.

After the fifth time T5 and a predetermined time Tc are passed, the second image-displaying voltage V1 is applied to the electrophoretic particles 314 and 316 positioned in the first to third pixel areas A1, A2, and A3 for respective tenth to twelfth times T10, T11, and T12 to display other desired images. Here, the second image-displaying voltage V1 is not applied to the fourth pixel area A4.

Accordingly, the first electrophoretic particles 314 and the second electrophoretic particles 316 positioned in the first to fourth pixel areas A1, A2, A3, and A4 are arranged as shown in FIG. 17.

Along with the arrangement shown in FIG. 17, the first pixel area A1 displays the third gray image that is the brightest, the second pixel area A2 display the second gray image that is darker than the third gray image, the third pixel area A3 displays the first gray image that is darker than the second gray image, and the fourth pixel area A4 displays the zeroth gray image that is the darkest, as shown in FIG. 18.

In the present embodiment, though the first to fourth pixel areas A1, A2, A3, and A4 display the third gray image, the second gray image, the first gray image, and the zeroth gray image, respectively, the respective pixel areas A1, A2, A3, and A4 may display any one gray image of the zeroth gray image, the first gray image, the second gray image, and the third gray image. Accordingly, the entirety of the pixel areas A may display desired images by a combination of the four gray images.

Next, after the predetermined time Td, the second constant gray-displaying voltage V1 is applied to the electrophoretic particles 314 and 316 positioned in the second to fourth pixel areas A2, A3, and A4 for the thirteenth to fifteenth times T13, T14, and T15, respectively. Here, the second constant gray-displaying voltage V1 is not applied to the first pixel area A1.

Here, respective electrophoretic particles 314 and 316 positioned in the second pixel area A2 may preferably be supplied with the second constant gray-displaying voltage V1 for the thirteenth time T13 after the predetermined time Tb and the seventeenth time T17. In addition, respective electrophoretic particles 314 and 316 positioned in the third pixel area A3 may preferably be supplied with the second constant gray-displaying voltage V1 for the fourteenth time T14 after the predetermined time Tb and the sixteenth time T16.

Accordingly, after the sixteenth time T16 of the fifteenth time T15, the first electrophoretic particles 314 and the second electrophoretic particles 316 positioned in the first to fourth pixel areas A1, A2, A3, and A4 are arranged as shown in FIG. 19.

Along with the arrangement shown in FIG. 19, the first pixel area A1 displays the third gray image, the second pixel area A2 displays the second gray image, and the third pixel area A3 and the fourth pixel area A4 display the first gray images, as shown in FIG. 20. In comparison with images displayed in FIG. 18, the fourth pixel area A4 is changed to display the first gray image from the zeroth gray image.

After the seventeenth time T17, the first electrophoretic particles 314 and 316 positioned in the first to fourth pixel areas A1, A2, A3, and A4 are arranged as shown in FIG. 21.

Because of the arrangement shown in FIG. 21, the first pixel area A1 displays the third gray image, and the second pixel area A2, the third pixel area A3, and the fourth pixel area A4 display the second gray image, respectively. In comparison with images displayed in FIG. 20, the third pixel area A3 and the fourth pixel area A4 are changed to display the second gray image from the first gray image.

After the entire fifteenth time T15, the first electrophoretic particles 314 and 316 positioned in the first to fourth pixel areas A1, A2, A3, and A4 are arranged as shown in FIG. 23.

Accordingly, the first to the fourth pixel areas A1, A2, A3, and A4 display the third gray image of the brightest as shown in FIG. 24. In comparison with images displayed in FIG. 22, the second to fourth pixel areas A2, A4, and A4 are changed to display the third gray image from the second gray image.

As described above, the electrophoretic particles 314 and 316 of the second pixel area A3 are supplied with the second constant gray-displaying voltage V1 for the fourteenth time T14 after the sixteenth time T16 of the fifteenth time T15, and the electrophoretic particles 314 and 316 of the second pixel area A2 are supplied with the second constant gray-displaying voltage V1 for the thirteenth time T13 after the seventeenth time T17 of the fifteenth time T15, and thereby the second to fourth pixel areas A2, A3, and A4 are gradually changed to display the third gray image that is the brightest without display performance deterioration of the electrophoretic display.

Next, after the predetermined time Te, the compensation voltage V2 is applied to the electrophoretic particles 314 and 316 positioned in the first to fourth pixel areas A1, A2, A3, and A4 for the eighteenth time T18, as shown in FIG. 16.

Accordingly, the electrophoretic particles 314 and 316 positioned in the first to fourth pixel areas A1, A2, A3, and A4 are arranged as shown in FIG. 14.

Because of the arrangement, the first to fourth pixel areas A1, A2, A3, and A4 display the zeroth gray image that is the darkest, as shown in FIG. 15.

The electrophoretic particles 314 and 316 positioned in the respective pixel areas A1, A2, A3, and A4 are supplied with the positive driving voltage and the negative driving voltage for the same period in total, and thereby the pixel electrodes 190 of the respective pixel areas A1, A2, A3, and A4 are refreshed to prevent incidental images.

The driving process described above may be repeated after a predetermined time Tc for displaying a desired image and preventing incidental images.

The driving method for the electrophoretic display according to an embodiment of the present invention described above will be summarized briefly as follows.

Referring to FIG. 16, after applying the first constant gray-displaying voltage V2, the second image-displaying voltage V1 is applied to the electrophoretic particles 314 and 316 of the respective pixel areas A1, A2, A3, and A4 for the tenth to twelfth times T10, T11, and T12, respectively, then the second constant gray-displaying voltage V1 is applied to the electrophoretic particles 314 and 316 of the second to fourth pixel areas A2, A3, and A4 for the thirteenth to fifteenth times T13, T14, and T15, respectively, and then the compensation voltage V2 is applied to the electrophoretic particles 314 and 316 of the respective pixel areas A1, A2, A3, and A4 for the eighteenth time T18.

Here, the second image-displaying voltage V1 and the second constant gray-displaying voltage V1 have the same value and polarity as the initial driving voltage V1, and they have the same magnitude and the opposite polarity to that of the compensation voltage V2.

Accordingly, the integrated time of applying the second image-displaying voltage V1 and the second constant gray-displaying voltage V1 is substantially the same as that of applying the compensation voltage V2 to the respective pixel areas A to refresh the pixel electrodes 190 of the respective pixel areas A.

The present embodiment may be modified within the condition that the integrated time of applying the second image-displaying voltage V1 and the second constant gray-displaying voltage V1, and that of applying the compensation voltage V2 are substantially the same.

Further, after the fifth time T5 has passed, the driving method described above may be repeated such that respective pixel areas A1, A2, A3, and A4 display gray images of the zeroth to third gray images after the fifth time T5.

In addition, the initial driving voltage V1 may have the opposite polarity to that described above such that the initial images may be changed to the zeroth gray image that is the darkest instead of the third gray image that is the brightest.

Here, the driving voltages V1 and V2 may also have the opposite polarity to that described above.

Hereinafter, a driving method for the electrophoretic display according to another embodiment of the present invention will be described referring to FIG. 5 and FIG. 16.

In the present embodiment, the driving method does not include applying the initial driving voltage V1 shown in FIG. 5, and the driving method includes applying the first image-displaying voltage V2 shown in FIG. 5, applying the first constant gray-displaying voltage V2 shown in FIG. 5 after applying the first image-displaying voltage V2, applying the second image-displaying voltage V1 shown in FIG. 16 after applying the first constant gray-displaying voltage V2, and applying the second constant gray-displaying voltage V1 shown in FIG. 16 after applying the second constant gray-displaying voltage V1.

Here, the integrated time of applying the first image-displaying voltage V2 and the first constant gray-displaying voltage V2 is substantially the same as that of applying the second image-displaying voltage V1 and the second constant gray-displaying voltage V1 for the respective pixel areas A.

The present embodiment may be modified within the condition that the integrated time of applying the first image-displaying voltage V2 and the first constant gray-displaying voltage V2 is substantially the same as that of applying the second image-displaying voltage V1 and the second constant gray-displaying voltage V1 for the respective pixel areas A.

Accordingly, the pixel electrodes 190 of the respective pixel areas A may be refreshed by the present invention embodiment.

In the described embodiments of the present invention, though the electrophoretic display displays four gray images of the zeroth to third gray images, the electrophoretic may display additional gray images by subdividing the magnitude of the voltages V1 and V2 or the applying time of the voltages V1 and V2.

In addition, the electrophoretic member 300 of the electrophoretic display may just include a dispersion medium 312 of a black color and the electrophoretic particles 314 having a white color.

In addition, each first electrophoretic particle 314 may have one color of red, green, and blue instead of white and the first electrophoretic particle 314 having a red color, the first electrophoretic particle 314 having a green color, and the first electrophoretic particle 314 having a blue color may be respectively arranged in one pixel area in turns such that the electrophoretic display may display various color images. Here, the first electrophoretic particles 314 having one color of red, green, and blue may be dispersed within the dispersion medium 312 along with the second electrophoretic particles 316 of a black color.

Further, each first electrophoretic particle 314 may have one color of yellow, magenta, and cyan instead of red, green, and blue.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A driving method for an electrophoretic display including a plurality of first electrodes, a second electrode, and electrophoretic particles positioned in a plurality of pixel areas between the first electrodes and the second electrode, the driving method comprising:

applying an initial driving voltage to the electrophoretic particles in a portion of the pixel areas for a predetermined time;

consecutively applying a first image-displaying voltage and a first constant gray-display voltage to the electrophoretic particles to a portion of the pixel areas for a first predetermined time period and a second predetermined time period, respectively, after the applying of the initial driving voltage, wherein the first image-displaying voltage and the first constant gray-displaying voltage are of substantially the same magnitude and have a polarity that is opposite to that of the initial driving voltage;

applying a second image-displaying voltage to the electrophoretic particles positioned in a portion of the plurality of pixel areas for a third predetermined time period;

applying a second constant gray-displaying voltage to the electrophoretic particles positioned in a portion of the plurality of pixel areas for a fourth predetermined time period; and generating a desired gray scale level by varying lengths of the first and second predetermined time periods and a separation period between the first and second predetermined time periods, wherein the plurality of pixel areas display any one gray scale image of a maximum gray scale image to a minimum gray scale image by applying the second image-displaying voltage, the respective pixel areas display the maximum gray scale image by applying the second constant gray-displaying voltage, and the respective pixel areas display the minimum gray scale image by applying the compensation voltage, wherein the second image-displaying voltage is applied for one of a tenth duration, an eleventh duration, and a twelfth duration, the second constant gray-displaying voltage is applied for one of a thirteenth duration, a fourteenth duration, and a fifteenth duration, and the compensation voltage is applied for an eighteenth duration, wherein the second constant gray-displaying voltage for displaying the maximum gray scale image is applied for the thirteenth duration, and the second constant gray-displaying voltage is applied after the seventeenth duration has passed, and wherein the second constant gray-displaying voltage for displaying the first color image is applied for the fourteenth duration, and the second constant gray-displaying voltage is applied after the sixteenth duration has passed, wherein the pixel area displaying the minimum gray scale image of the plurality of the pixel areas displays a second middle gray scale image brighter than the minimum gray scale image after the sixteenth duration has passed, and the pixel area displaying the second middle gray scale image of the plurality of the pixel areas displays a first middle gray scale image brighter than the second middle gray scale image after the seventeenth duration has passed.

2. The driving method of claim 1, wherein the plurality of pixel areas display any one gray scale image of the minimum gray scale image to a maximum gray scale image by applying the first image-displaying voltage, respectively and the respective pixel areas display a minimum gray scale image by applying the first constant gray-displaying voltage.

3. The driving method of claim 2, wherein the maximum gray scale image is a brightest white and the minimum gray scale image is a darkest black, the brightness of the gray scale image becomes darker from the maximum gray scale image to the minimum gray scale image.

4. The driving method of claim 1, wherein the initial driving voltage is applied for a first duration, the first image-displaying voltage is applied for one of a second duration, a third duration, and a fourth duration, and the first constant gray-displaying voltage is applied for one of a fifth duration, a sixth duration, and a seventh duration.

5. The driving method of claim 4, wherein the fourth duration is substantially the same as the first duration.

6. The driving method of claim 5, wherein the length of the second duration is about one third of that of the fourth duration, and the length of the third duration is about two thirds of that of the fourth duration.

7. The driving method of claim 4, wherein the fifth duration is substantially the same as the first duration, the length of the sixth duration is about two thirds of that of the fifth duration, and the length of the seventh duration is about one third of that of the fifth duration.

8. The driving method of claim 4, wherein the first constant gray-displaying voltage for displaying the minimum gray scale image is applied for the sixth duration, the first constant gray-displaying voltage is applied after the eighth duration has passed, and wherein the first constant gray-displaying voltage for displaying the fourth color image is applied for the seventh duration, and the first constant gray-displaying voltage is applied after the ninth duration has passed.

9. The driving method of claim 8, wherein the length of the eighth duration is about one third of that of the fifth duration, and the length of the ninth duration is about two thirds of that of the fifth duration.

10. The driving method of claim 8, wherein the pixel area displaying the maximum gray scale image of the plurality of the pixel areas displays a first middle gray scale image darker than the maximum gray scale image after the eighth duration has passed.

11. The driving method of claim 10, wherein the pixel area displaying the first middle gray scale image of the plurality of the pixel areas displays a second gray scale image darker than the first middle gray scale after the ninth duration has passed.

12. The driving method of claim 1, further comprising:

applying a compensation voltage having a polarity that is opposite to that of the initial driving voltage to the electrophoretic particles positioned in the plurality of pixel areas for a fifth predetermined time period after applying the second constant gray-displaying voltage.

13. The driving method of claim 12, wherein the second image-displaying voltage, the second constant gray-displaying voltage, and the compensation voltage have substantially equal magnitude.

14. The driving method of claim 1, wherein the tenth duration, the fifteenth duration, and the eighteenth duration is substantially the same as the first time.

15. The driving method of claim 14, wherein the length of the eleventh duration is about two thirds of that of the tenth duration, the length of the twelfth duration is about one third of that of the tenth duration, the length of the thirteenth duration is about one third of that of the fifteenth duration, and the length of the fourteenth duration is about two thirds of that of the fifteenth duration.

16. The driving method of claim 1, wherein the length of the sixteenth duration is about one third of that of the fifteenth duration, and the length of the seventeenth duration is about two thirds of that of the fifteenth duration.

* * * * *